US012078442B1

(12) United States Patent
Johnson

(10) Patent No.: US 12,078,442 B1
(45) Date of Patent: Sep. 3, 2024

(54) SIDE CHARGER UPPER RECEIVER ASSEMBLY FOR A FIREARM

(71) Applicant: Alexandria Pro-Fab Co., Inc., Alexandria, MN (US)

(72) Inventor: Ryan Johnson, Alexandria, MN (US)

( * ) Notice: Subject to any disclaimer, the term of this patent is extended or adjusted under 35 U.S.C. 154(b) by 0 days.

(21) Appl. No.: 18/323,275

(22) Filed: May 24, 2023

(51) Int. Cl.
*F41A 3/72* (2006.01)
*F41A 3/66* (2006.01)

(52) U.S. Cl.
CPC . *F41A 3/72* (2013.01); *F41A 3/66* (2013.01)

(58) Field of Classification Search
CPC ..... F41A 3/72; F41A 3/66
USPC ..... 89/1.4
See application file for complete search history.

(56) References Cited

U.S. PATENT DOCUMENTS

| | | | | |
|---|---|---|---|---|
| 8,333,137 | B2 | 12/2012 | Sirochman | |
| 8,342,075 | B2 | 1/2013 | Gomez | |
| 8,567,301 | B1 | 10/2013 | Sharron | |
| 9,194,635 | B1 | 11/2015 | Gibbens | |
| 9,310,146 | B2 | 4/2016 | Gibbens | |
| 9,423,194 | B2 | 8/2016 | Fritz | |
| 9,541,339 | B2 | 1/2017 | Orne, III | |
| 9,702,648 | B1 | 7/2017 | Pollack | |
| 9,746,263 | B2 | 8/2017 | Hillman | |
| 9,835,411 | B2 | 12/2017 | Larson, Jr. | |
| 9,958,229 | B1 | 5/2018 | Meier | |
| 10,001,328 | B1 | 6/2018 | Parker | |
| 10,345,059 | B2 | 7/2019 | Gibbens | |
| 10,443,964 | B2 | 10/2019 | Brown | |
| 10,697,722 | B2 | 6/2020 | Kling | |
| 11,274,889 | B2 | 3/2022 | Hubbell | |
| 11,280,567 | B1 | 3/2022 | Hart | |
| 2011/0061523 | A1 | 3/2011 | Webb | |
| 2011/0083551 | A1* | 4/2011 | Sirochman | F41A 5/18 89/1.4 |
| 2013/0174457 | A1 | 7/2013 | Gangl | |
| 2017/0205162 | A1 | 7/2017 | Beaty | |
| 2021/0180896 | A1 | 6/2021 | Noonan | |
| 2022/0236032 | A1 | 7/2022 | Hamilton | |

* cited by examiner

*Primary Examiner* — Reginald S Tillman, Jr.
(74) *Attorney, Agent, or Firm* — Fargo Patent & Business Law; Thomas Kading

(57) ABSTRACT

An upper receiver assembly includes a side charger upper receiver body with an upper receiver raceway that extends along a portion of a lateral side of the side charger upper receiver body. A first and second rail along at least a portion of a length of the upper receiver raceway. A slider is movable along the upper receiver raceway parallel to a body axis which is coaxial with the side charger upper receiver body and a paddle pivotably mounted to the side charging handle, the paddle movable between an engaged position engaged with the first rail and the second rail and a disengaged position disengaged from the first rail and the second rail.

20 Claims, 10 Drawing Sheets

SIDE CHARGER UPPER RECEIVER ASSEMBLY FOR A FIREARM

BACKGROUND

The present disclosure relates to a charging handle for an upper receiver assembly for a firearm and more particularly to a side charger for an AR style firearm.

An AR-15 platform type firearm utilizes a charging handle that is located at the top rear of the upper receiver assembly. This location may result in gas blowback toward the face of an operator, particularly with use of a suppressor. This top rear location may also require movement away from a typical shooting position to charge the firearm.

SUMMARY

An upper receiver assembly according to one disclosed non-limiting embodiment of the present disclosure includes a side charger upper receiver body with an upper receiver raceway that extends along a portion of a lateral side of the side charger upper receiver body; a first rail along at least a portion of a length of the upper receiver raceway; a second rail along at least a portion of the length of the upper receiver raceway; a slider movable along the upper receiver raceway parallel to a body axis which is coaxial with the side charger upper receiver body; a side charging handle mounted to the slider; a bolt carrier engagement member mounted to the slider and the side charging handle; and a paddle pivotably mounted to the side charging handle, the paddle movable between an engaged position engaged with the first rail and the second rail and a disengaged position disengaged from the first rail and the second rail.

A further embodiment of any of the foregoing embodiments of the present disclosure includes that the body axis is coaxial with a barrel of a barrel assembly.

A further embodiment of any of the foregoing embodiments of the present disclosure includes that the first rail and the second rail are parallel.

A further embodiment of any of the foregoing embodiments of the present disclosure includes that the first rail comprises a first indent and the second rail comprise a second indent.

A further embodiment of any of the foregoing embodiments of the present disclosure includes that the paddle engages the first indent and the second indent in the engaged position.

A further embodiment of any of the foregoing embodiments of the present disclosure includes that the paddle is pivotably mounted to the aft portion of the side charging handle.

A further embodiment of any of the foregoing embodiments of the present disclosure includes that the paddle is pivotably mounted along a pivot axis transverse to the body axis.

A further embodiment of any of the foregoing embodiments of the present disclosure includes that the paddle is biased toward an actuated position in which the paddle is biased toward the first rail and the second rail.

A further embodiment of any of the foregoing embodiments of the present disclosure includes that the paddle comprises a planar actuation surface.

A further embodiment of any of the foregoing embodiments of the present disclosure includes that the first rail and the second rail provide a respective inner contour to retain the slider.

A further embodiment of any of the foregoing embodiments of the present disclosure includes that the first rail and the second rail are parallel to the body axis.

A further embodiment of any of the foregoing embodiments of the present disclosure includes that the paddle rides along a respective edge of the first rail and the second rail.

A further embodiment of any of the foregoing embodiments of the present disclosure includes that the paddle comprises a curved forward surface opposite the paddle.

A further embodiment of any of the foregoing embodiments of the present disclosure includes that a first and second fastener sandwich the slider between the side charging handle and the bolt carrier engagement member, a head of the first and second fastener captured within the side charging handle and the first and second fastener threaded into the bolt carrier engagement member.

A further embodiment of any of the foregoing embodiments of the present disclosure includes that the side charging handle comprises a rectilinear opening, the head of the first and second fastener accessible through the rectilinear opening.

A further embodiment of any of the foregoing embodiments of the present disclosure includes that the bolt carrier engagement member engages a mil-spec bolt carrier.

A further embodiment of any of the foregoing embodiments of the present disclosure includes a gas cap that encloses an aft end portion of the side charger upper receiver body.

A further embodiment of any of the foregoing embodiments of the present disclosure includes that the gas cap is removably retained to the side charger upper receiver body by a takedown pin which, in turn is retained by a takedown detent and spring.

An upper receiver assembly according to one disclosed non-limiting embodiment of the present disclosure includes a side charger upper receiver body that comprises an upper receiver raceway that extends along a portion of a lateral side of the side charger upper receiver body; a first rail along at least a portion of a length of the upper receiver raceway; a second rail along at least a portion of the length of the upper receiver raceway; a gas cap; and a takedown pin in the side charger upper receiver body which is retained by a takedown detent and spring, the takedown pin engageable with the gas cap to enclose an aft end portion of the side charger upper receiver body.

A side charging handle assembly according to one disclosed non-limiting embodiment of the present disclosure includes a slider; a side charging handle; a paddle pivotably mounted to the side charging handle, the paddle biased toward an engaged position; a bolt carrier engagement member; and a first and second fastener threaded into the bolt carrier engagement member to sandwich the slider between the side charging handle and the bolt carrier engagement member, a head of the first and second fastener captured within the side charging handle.

The foregoing features and elements may be combined in various combinations without exclusivity, unless expressly indicated otherwise. These features and elements as well as the operation thereof will become more apparent in light of the following description and the accompanying drawings. It should be appreciated that however the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
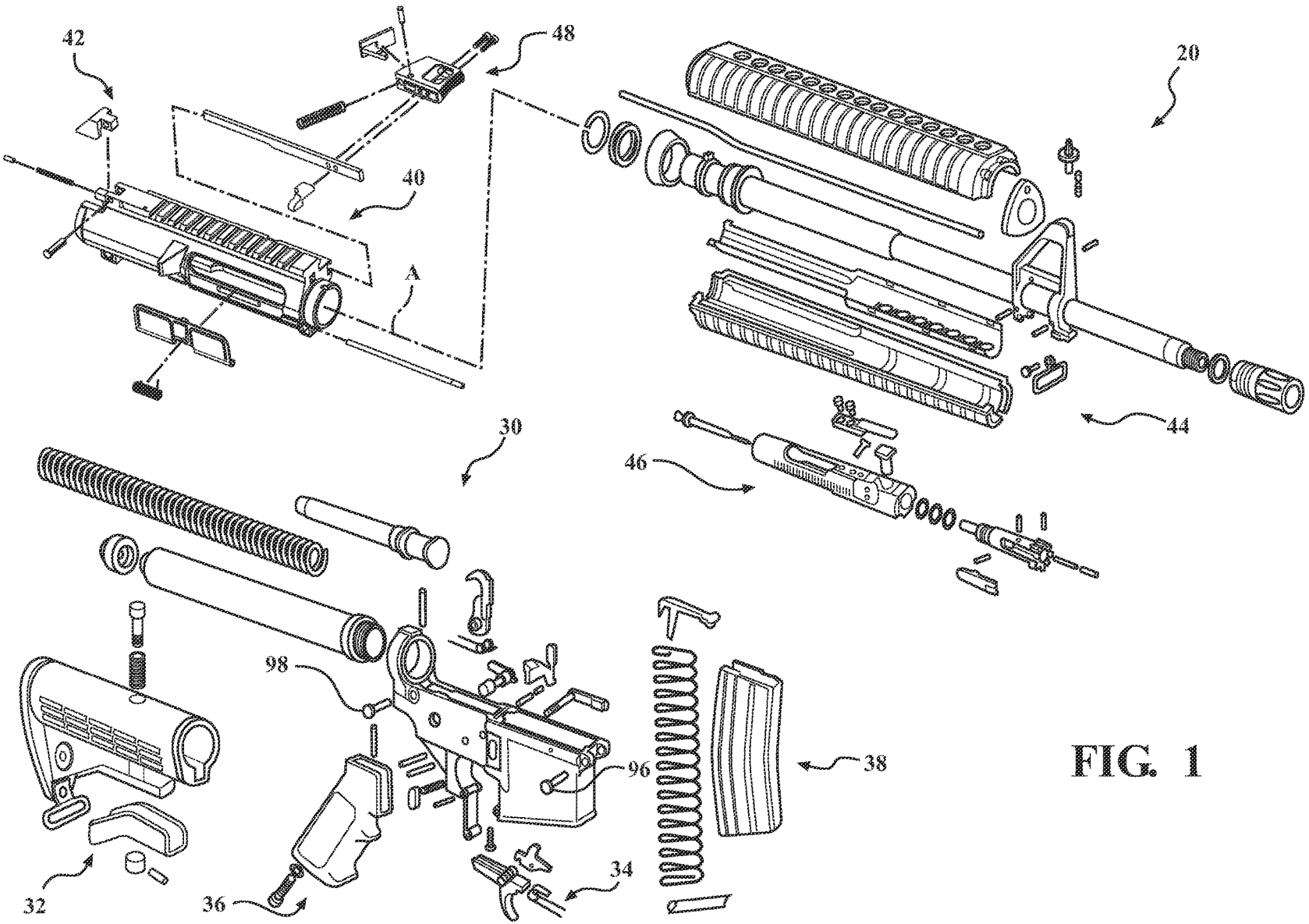
FIG. 1 is an exploded view of an AR-15 platform type firearm according to one disclosed non-limiting embodiment.

FIG. 1 schematically illustrates an exploded view of an AR-15 platform type firearm 20 with a lower receiver assembly 30 and a side charger upper receiver assembly 40 that includes a side charger manual of operations. It should be appreciated that although a particular firearm is disclosed in the illustrative embodiment, many firearms will benefit herefrom.

The lower receiver assembly 30 generally includes a butt stock assembly 32, a trigger group 34, a pistol grip assembly 36, and a removable magazine 38. The upper receiver assembly 40 generally includes a side charger upper receiver 42, a barrel assembly 44, a bolt carrier group 46, and a side charging handle assembly 48. The upper receiver assembly 40 may be removably mounted (e.g., via takedown pins) to the lower receiver assembly 30. It will be understood that although the major assemblies are shown, other components as typically assembled in an AR style firearm may not be specifically discussed herein.

The upper receiver assembly 40, in one disclosed embodiment, advantageously utilizes a MIL-SPEC bolt carrier group 46. Mil-Spec is an abbreviated term that stands for "military specification." For a firearm component to be Mil-Spec, every aspect has to meet criteria defined by the military to often include dimensions, materials, testing of parts, etc., ensuring a certain level of expectations for the performance and maintainability of military equipment. That is, the bolt carrier group 46 is conventional and interchangeable with other conventional AR-15 platform type firearm 20 and does not require any special modification to use with the side charger upper receiver 42, and the side charging handle assembly 48.

Figure 2:
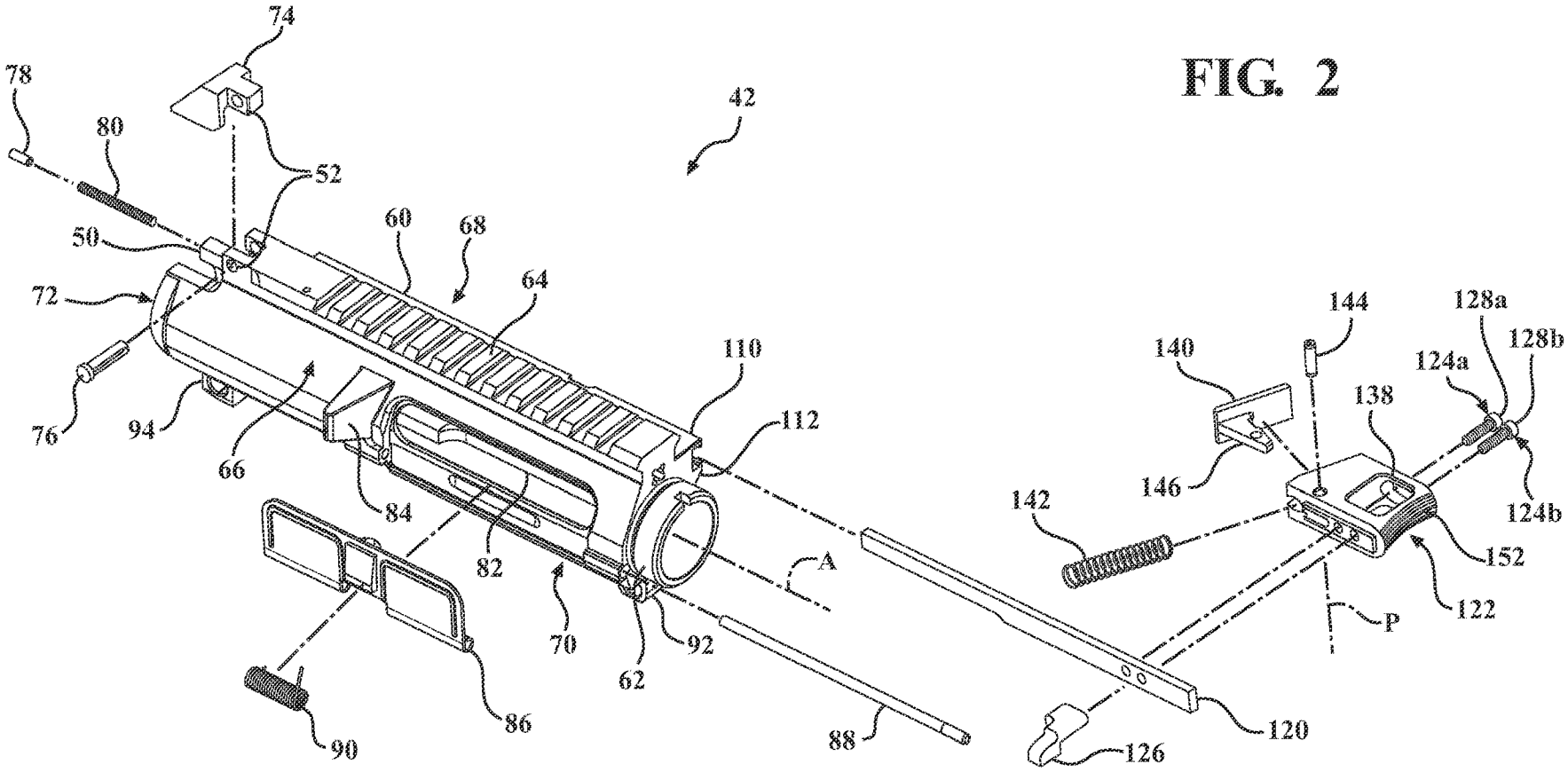
FIG. 2 is an exploded view of a side charger upper receiver assembly according to another disclosed non-limiting embodiment.
Figure 3:
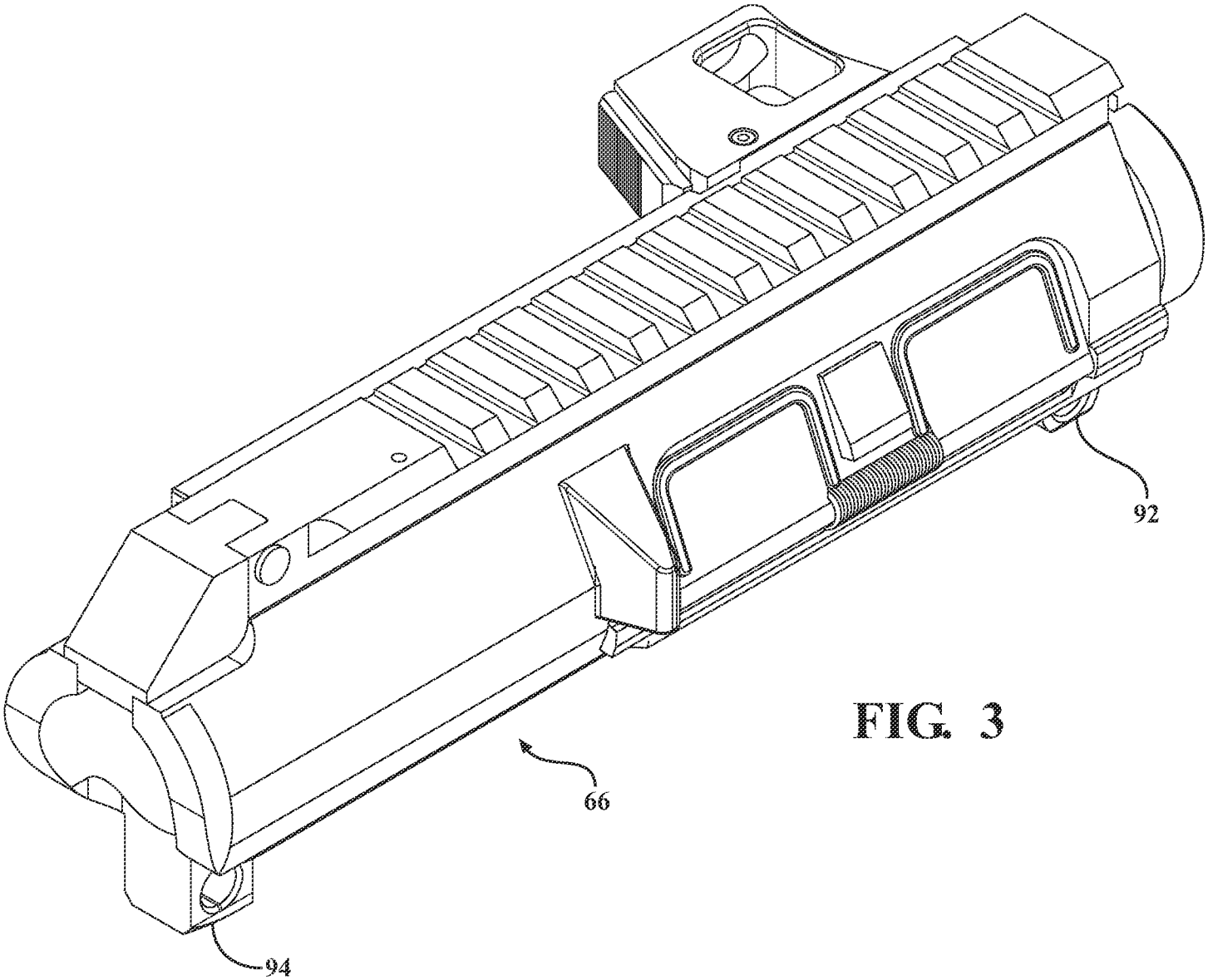
FIG. 3 is a perspective view of an ejection side of the side charger upper receiver assembly.
Figure 4:
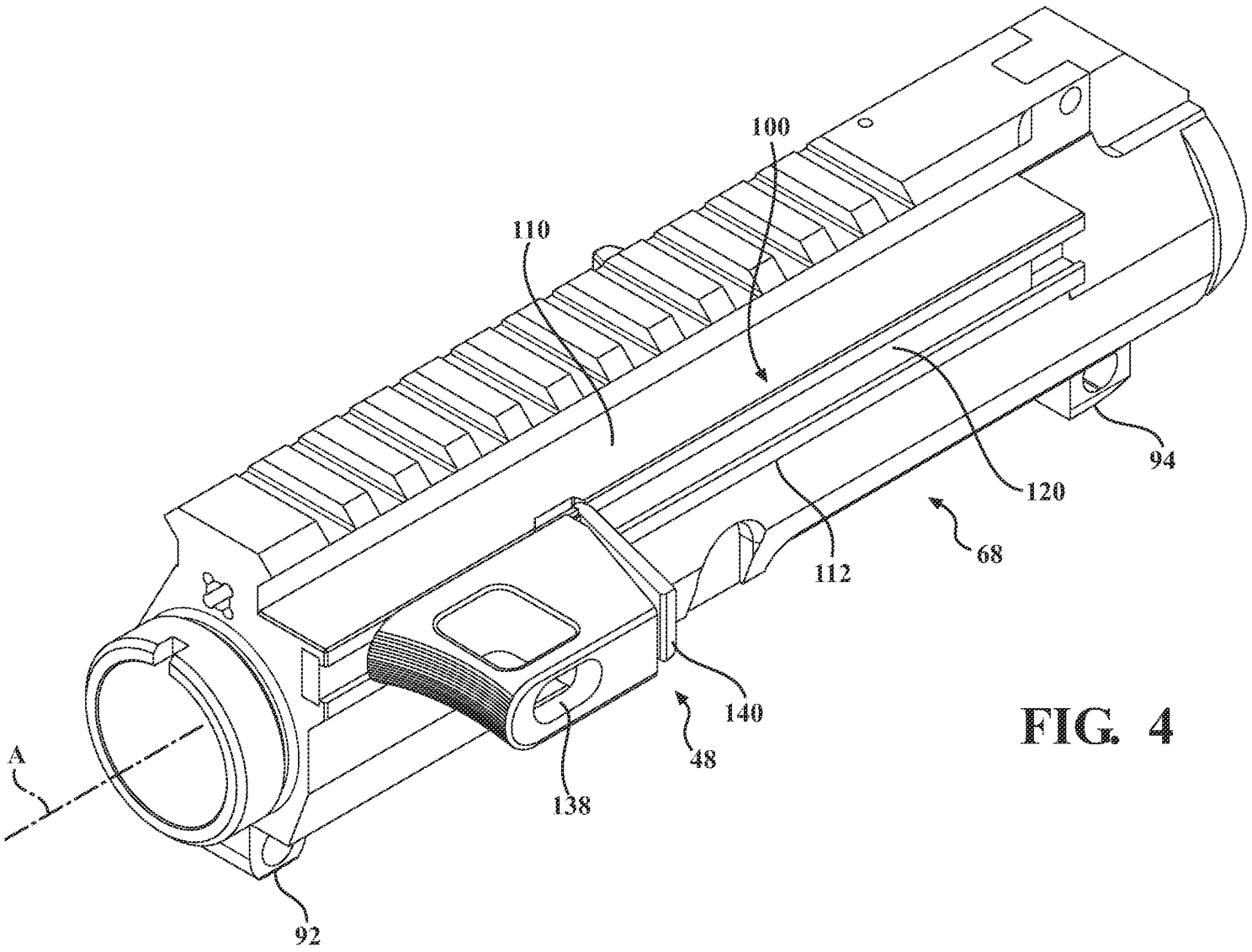
FIG. 4 is a perspective view of a side charger side of the side charger upper receiver assembly.

With reference to FIG. 2, the side charger upper receiver 42 generally includes a side charger upper receiver body 60 that defines an axis A which is coaxial with the barrel of the barrel assembly 44. The side charger upper receiver body 60 generally includes a threaded forward section 62, an upper surface 64, an ejection side 66 (also shown in FIG. 3), a side charger side 68 (also shown in FIG. 4), a lower side 70 and an aft end 72.

The threaded forward section 62 of the side charger upper receiver body 60 receives the barrel assembly 44 while the aft end 72 opposite thereto is closed by a gas cap 74. The gas cap 74 may be removably retained by a takedown pin 76 which, in turn is retained by a takedown detent 78 and spring 80. The takedown detent 78 and spring 80 are located within a bore 50 in the side charger upper receiver body 60 transverse to a pin bore 52 that receives the takedown detent 78 such that the detent 78 is biased by the spring 80 into engagement with the takedown detent 78 to capture the takedown detent 78. That is, the takedown detent 78 does not fall out of the side charger upper receiver body 60 when disengaged from the gas cap 74. The gas cap 74 is readily removed from the side charger upper receiver body 60 by the expedient of the captured takedown pin 76 such that the bolt carrier group 46 is readily installed and removed into the side charger upper receiver body 60 along axis A.

The upper surface 64 may include a railed surface such as a picatinny rail, etc. Alternatively, the upper surface 64 may include a carry handle, fixed sight, or other such confirmation.

The ejection side 66 (also shown in FIG. 3) of the side charger upper receiver body 60 includes an ejection port 82, aft of which may be a case deflector 84. The ejection port is typically selectively covered by a dust cover 86 which is pivotally mounted to the ejection side 66 via a hinge pin 88 and spring 90 arrangement.

The lower side 70 of the side charger upper receiver body 60 is typically substantially open and includes a forward lug 92 and an aft lug 94 that receives a respective takedown pin 96, 98 (FIG. 1) in the lower receiver assembly 30 to affix the upper receiver assembly 40 to the lower receiver assembly 30. The utilization of the captured takedown pin 76 corresponds with the respective captured takedown pin 96, 98 that are conventionally utilized. An operator thereby need only push out the captured takedown pin 76, 96, 98 to disassemble the upper receiver assembly 40 from the lower receiver assembly 30, remove the gas cap 74 and then remove the bolt carrier group 46 through the aft end 72.

Figure 5:
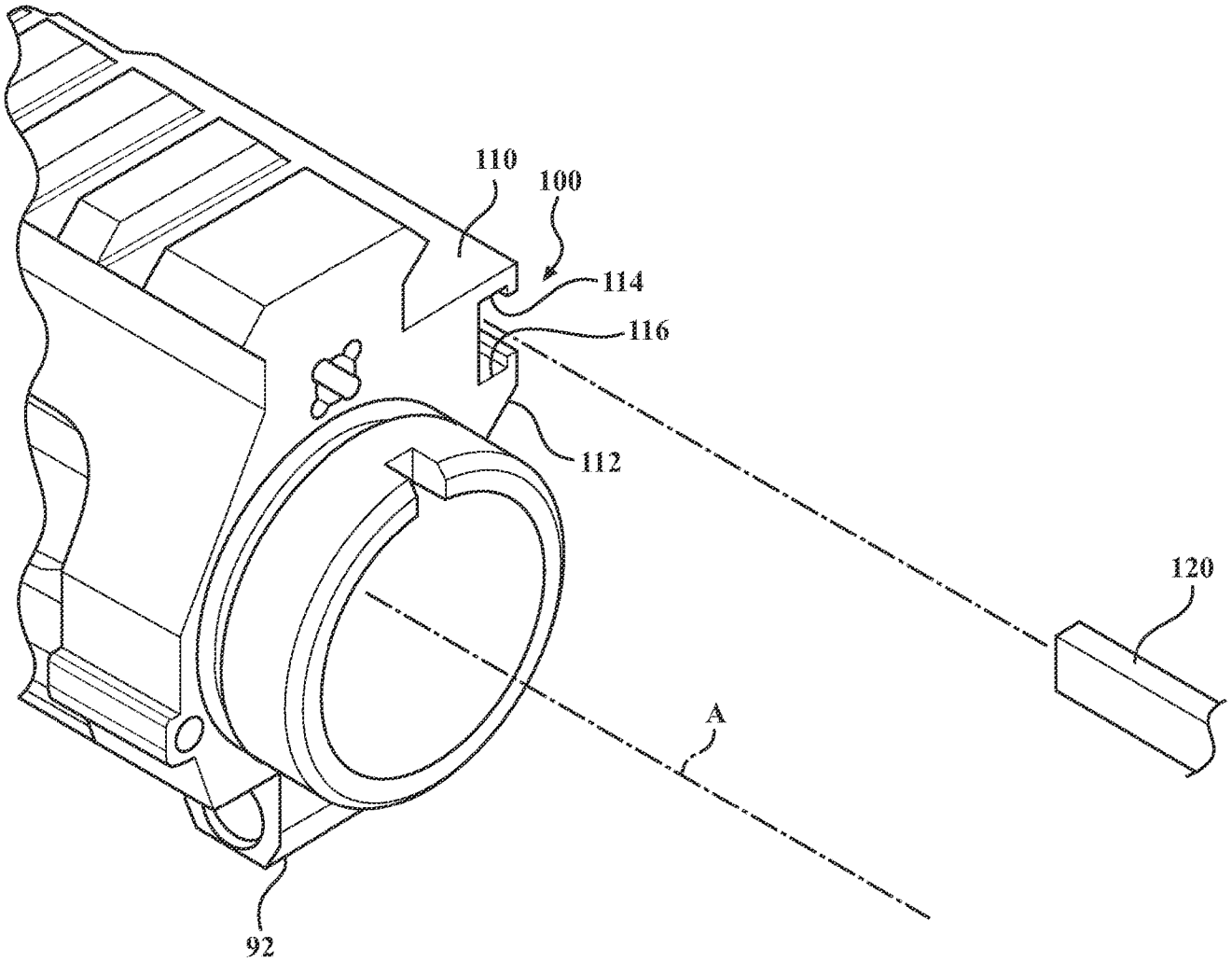
FIG. 5 is a front perspective view of an ejection side of the side charger upper receiver assembly.
Figure 6:
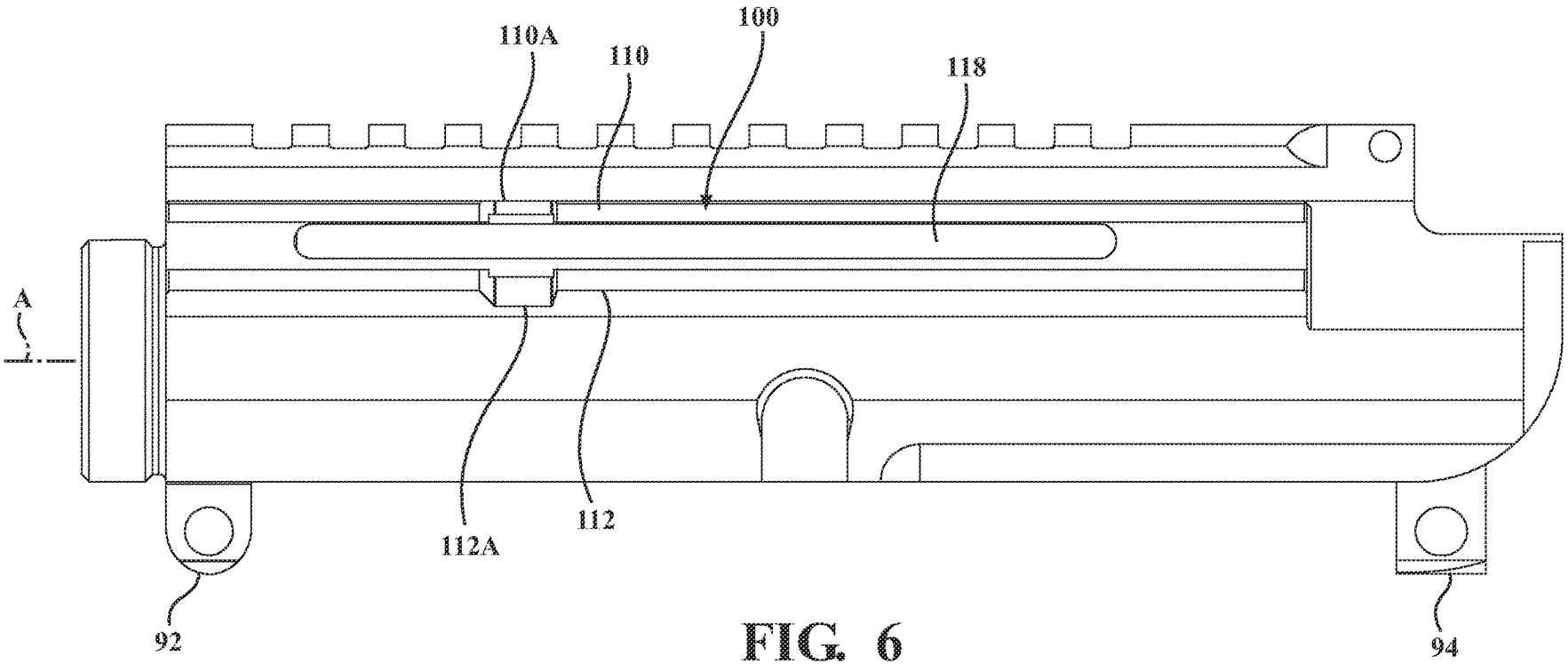
FIG. 6 is a side view of the side charger side of the side charger upper receiver assembly.
Figure 7:
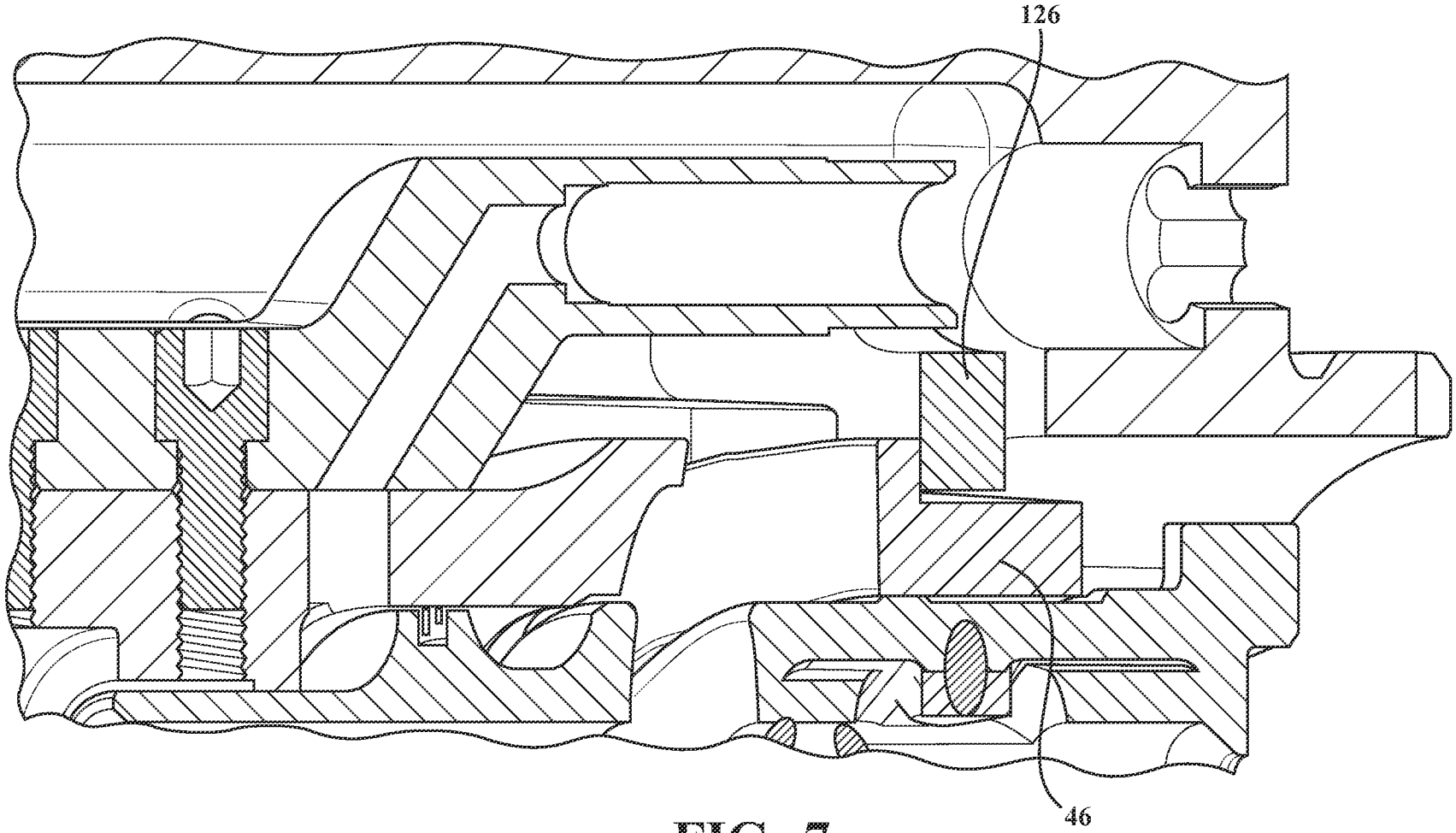
FIG. 7 is a sectional side perspective view of the ejection side of the side charger upper receiver assembly.

The side charger side 68 (also shown in FIG. 4) of the side charger upper receiver body 60 includes an upper receiver raceway 100 (also shown in FIGS. 5 and 6) that extends along a portion of the side charger side 68 parallel to axis A. The upper receiver raceway 100 guides the side charging handle assembly 48 and provides access to the interior of the side charger upper receiver body 60 to permit the side charging handle assembly 48 to engage the bolt carrier group 46 (FIG. 7).

A first rail 110 and a second rail 112 extends along at least a portion of a length of the upper receiver raceway 100. The first rail 110, and the second rail 112 extend laterally from the side charger side 68 to form the upper receiver raceway 100. That is, the first rail 110, and the second rail 112 extend laterally outward from the side charger side 68 adjacent to a slot 118 (FIG. 6) formed in the side charger side 68 through which a bolt carrier engagement member 126 extends to engage the bolt carrier group 46 (FIG. 7). In one embodiment, the bolt carrier engagement member 126 engages a raised lip on the bolt carrier forward of the bolt cam and gas key.

The first rail 110, and the second rail 112 provide a respective inner contour 114, 116 (best seen in FIG. 5) to retain a slider 120 of the side charging handle assembly 48.

That is, the slider 120 may slide axially parallel to axis A but is laterally captured by the inner contour 114, 116.

The slider 120 is essentially a rectilinear bar that slides between the first rail 110 and a second rail 112 and encloses the slot 118. That is, the slider 120 covers the slot 118 (FIG. 4) when the side charging handle assembly 48 is in the forward locked position. The side charging handle assembly 48 does not reciprocate with the bolt carrier group 46 thereby preventing debris, etc., from entering the action.

The side charging handle assembly 48 includes a side charging handle 122 mounted to the slider 120 by a first and second fastener 124*a*, 124*b*, for example, 4-40 7/16 socket head cap screws. The first and second fastener 124*a*, 124*b* sandwich the slider 120 between the side charging handle 122 and the bolt carrier engagement member 126. A head 128*a*, 128*b* of the first and second fastener 124*a*, 124*b* are captured within the side charging handle 122 and the first and second fastener 124*a*, 124*b* are threaded into the bolt carrier engagement member 126. The head 128*a*, 128*b* of the first and second fastener 124*a*, 124*b* may be accessible through a rectilinear opening 138 of the side charging handle 122.

A paddle 140 is pivotably mounted to the side charging handle 122 by a pin 144. The paddle 140 is movable between an engaged position (FIG. 9), engaged with the first rail 110 and the second rail 112, and a disengaged position (FIG. 8), disengaged from the first rail 110 and the second rail 112. The first rail 110 and the second rail 112 are parallel and include a respective first indent 110A and second indent 112A that receives the paddle 140 to lock the side charging handle assembly 48 into a forward locked position.

In one embodiment, the paddle 140 is spring biased by a spring 142 that engages a cam 146 on the paddle 140 to bias the paddle 140 toward the engaged position. That is, the paddle 140 is spring biased toward an edge of the first rail 110 and the second rail 112 such that the paddle 140 rides along a respective edge of the first rail 110 and the second rail 112 under spring bias to engage the first indent 110A and the second indent 112A when biased into the engaged position by force of the recoil spring within the butt stock assembly 32. The paddle 140, being spring biased into engagement with the first rail 110 and the second rail 112, thence into the first indent 110A and the second indent 112A when the firearm is in battery, essentially locks the side charging handle assembly 48 into the forward position, such that when the firearm cycles, the side charging handle assembly 48 remains fixed in position.

Figure 8:
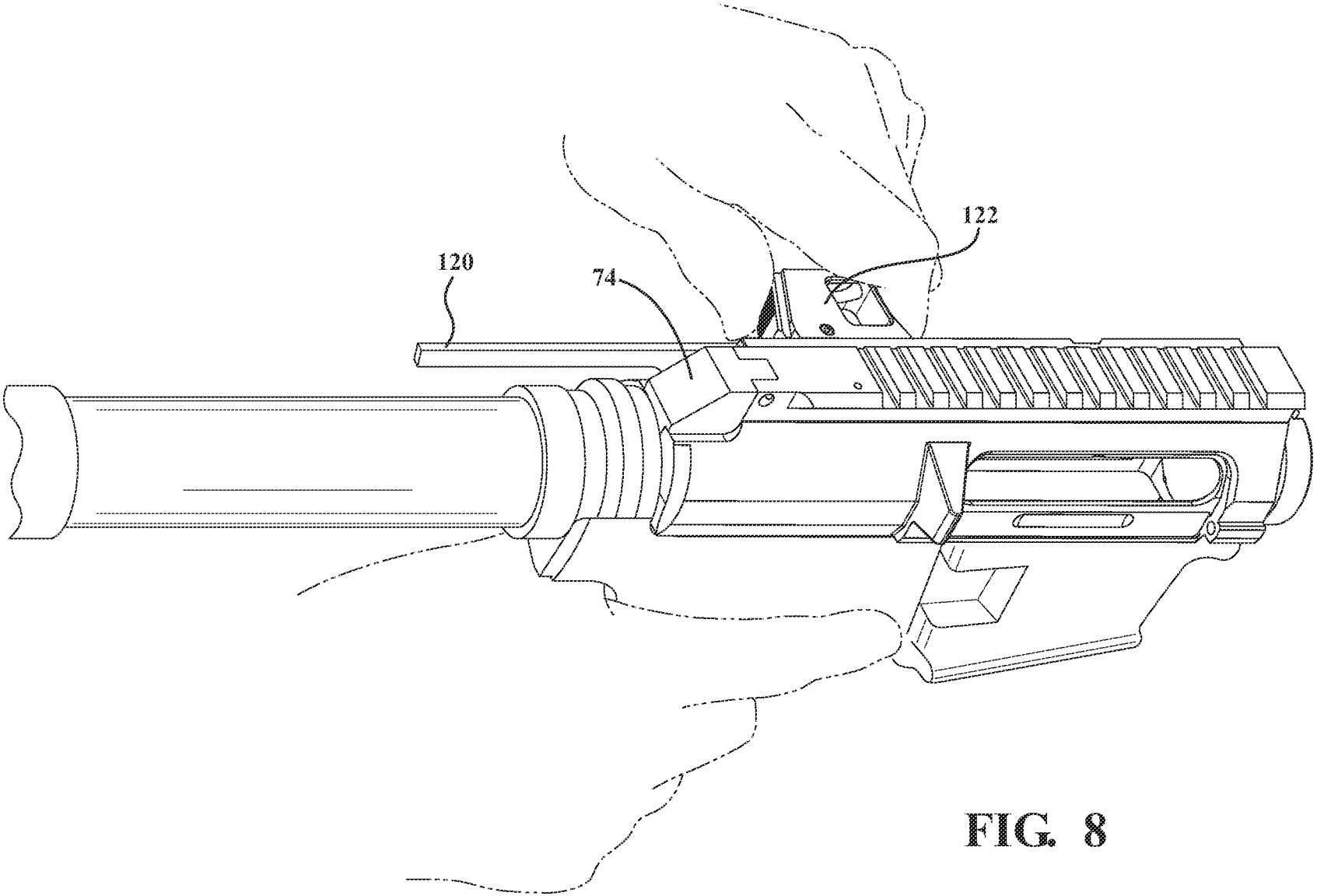
FIG. 8 is a perspective view of the ejection side of the side charger upper receiver assembly with the side charging handle assembly in a racked position.
Figure 9:
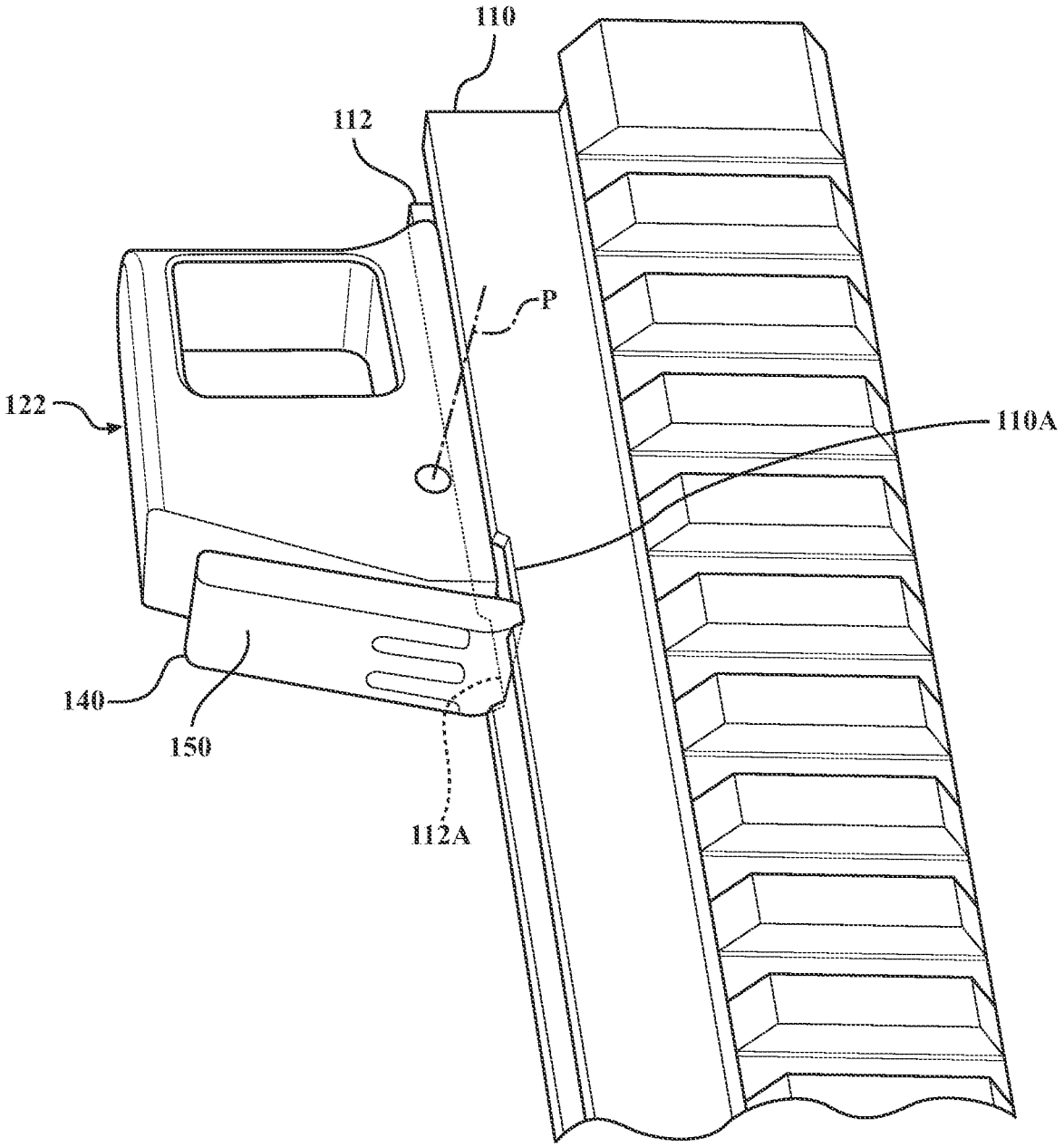
FIG. 9 is a top perspective view of the side charging handle assembly in a forward locked position.
Figure 10:
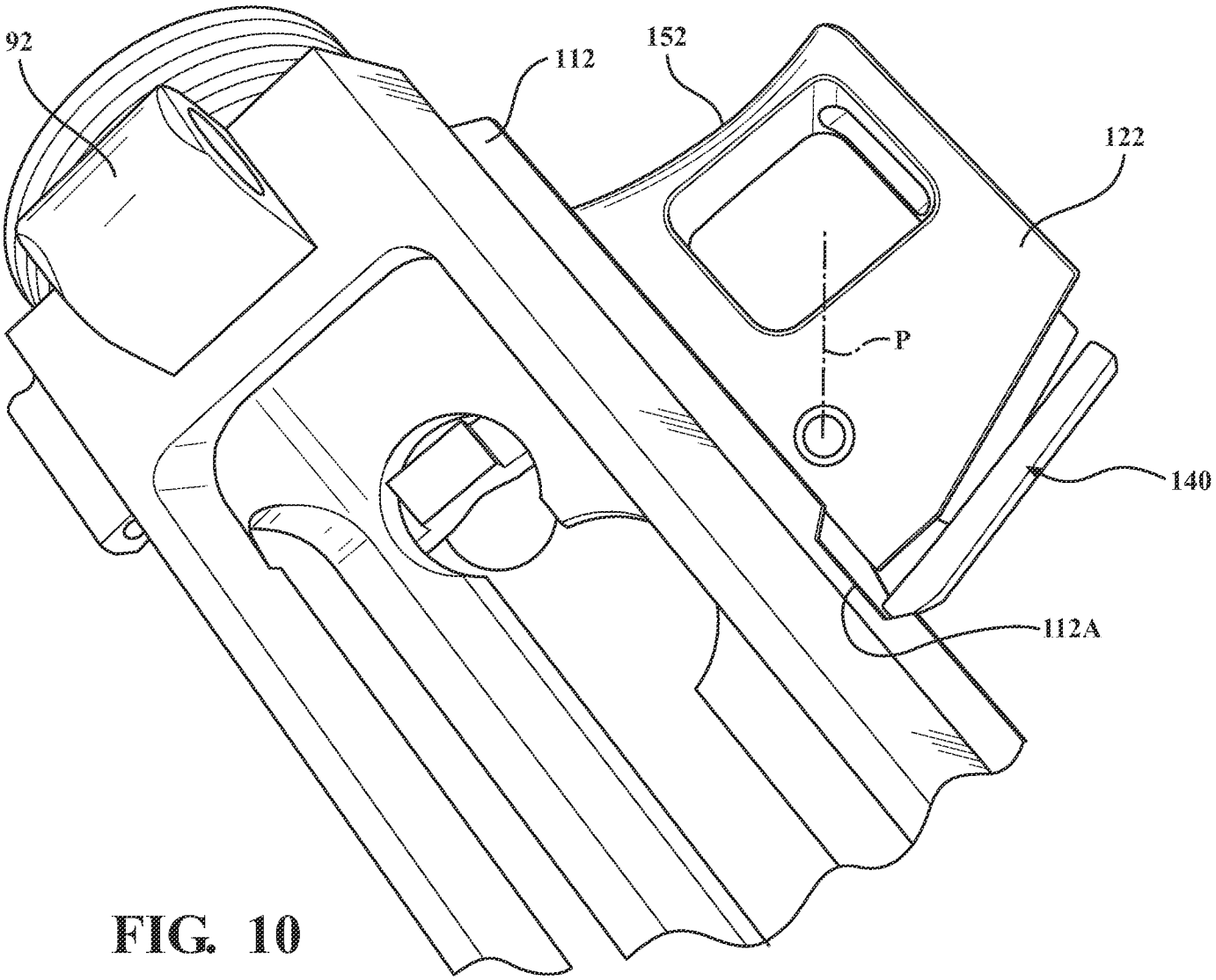
FIG. 10 is a bottom perspective view of the side charging handle assembly in a forward locked position.

The paddle 140 is pivotably mounted to an aft portion of the side charging handle 122 along a pivot axis P transverse to the body axis A. The paddle 140 includes a planar actuation surface 150 (FIG. 9) typically actuated by an operator's thumb (FIG. 8). The planar actuation surface 150 provides for significant purchase by the operator. The side charging handle 122 may also include a curved forward surface 152 (FIG. 10) opposite the paddle 140 typically engaged by the operator's index and middle and finger of the off-hand (FIG. 8).

The side charger upper receiver 42 provides an effective drop in side charger conversion that advantageously utilizes MIL-SPEC components. The side charging handle 122 provides ergonomic side charging of the firearm not heretofore available as the operator's thumb is conveniently positioned on the relatively large surface paddle 140 to unlock the side charging handle assembly 48.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed is:

1. An upper receiver assembly, comprising:

a side charger upper receiver body that comprises an upper receiver raceway that extends along a portion of a lateral side of the side charger upper receiver body;

a first rail along at least a portion of a length of the upper receiver raceway;

a second rail along at least a portion of the length of the upper receiver raceway;

a slider movable along the upper receiver raceway parallel to a body axis which is coaxial with the side charger upper receiver body;

a side charging handle mounted to the slider;

a bolt carrier engagement member mounted to the slider and the side charging handle; and a paddle pivotably mounted to the side charging handle, the paddle movable between an engaged position engaged with the first rail and the second rail and a disengaged position disengaged from the first rail and the second rail.

2. The upper receiver assembly as recited in claim 1, wherein the body axis is coaxial with a barrel of a barrel assembly.

3. The upper receiver assembly as recited in claim 1, wherein the first rail and the second rail are parallel.

4. The upper receiver assembly as recited in claim 3, wherein the first rail comprises a first indent and the second rail comprise a second indent.

5. The upper receiver assembly as recited in claim 4, wherein the paddle engages the first indent and the second indent in the engaged position.

6. The upper receiver assembly as recited in claim 5, wherein the paddle is pivotably mounted to the aft portion of the side charging handle.

7. The upper receiver assembly as recited in claim 6, wherein the paddle is pivotably mounted along a pivot axis transverse to the body axis.

8. The upper receiver assembly as recited in claim 6, wherein the paddle is biased toward the engaged position in which the paddle is biased toward the first rail and the second rail.

9. The upper receiver assembly as recited in claim 8, wherein the paddle comprises a planar actuation surface.

10. The upper receiver assembly as recited in claim 9, wherein the first rail and the second rail provide a respective inner contour to retain the slider.

11. The upper receiver assembly as recited in claim 10, wherein the first rail and the second rail are parallel to the body axis.

12. The upper receiver assembly as recited in claim 11, wherein the paddle rides along a respective edge of the first rail and the second rail in the engaged position.

13. The upper receiver assembly as recited in claim 12, wherein the paddle comprises a curved forward surface opposite the paddle.

14. The upper receiver assembly as recited in claim 13, further comprising a first and second fastener to sandwich the slider between the side charging handle and the bolt carrier engagement member, a head of the first and second fastener captured within the side charging handle and the first and second fastener threaded into the bolt carrier engagement member.

15. The upper receiver assembly as recited in claim 14, wherein the side charging handle comprises a rectilinear opening, the head of the first and second fastener accessible through the rectilinear opening.

16. The upper receiver assembly as recited in claim 1, wherein the bolt carrier engagement member engages a mil-spec bolt carrier.

17. The upper receiver assembly as recited in claim 16, further comprising a gas cap that encloses an aft end portion of the side charger upper receiver body.

18. The upper receiver assembly as recited in claim 17, wherein the gas cap is removably retained to the side charger upper receiver body by a takedown pin which, in turn is retained by a takedown detent and spring.

19. An upper receiver assembly, comprising:

a side charger upper receiver body that comprises an upper receiver raceway that extends along a portion of a lateral side of the side charger upper receiver body;

a first rail along at least a portion of a length of the upper receiver raceway;

a second rail along at least a portion of the length of the upper receiver raceway;

a gas cap; and a takedown pin retained by a takedown detent and spring in the side charger upper receiver body, the takedown pin engageable with the gas cap to enclose an aft end portion of the side charger upper receiver body.

20. A side charging handle assembly, comprising:

a slider;

a side charging handle;

a paddle pivotably mounted to the side charging handle, the paddle biased toward an engaged position;

a bolt carrier engagement member; and a first and second fastener threaded into the bolt carrier engagement member to sandwich the slider between the side charging handle and the bolt carrier engagement member, a head of the first and second fastener captured within the side charging handle.

* * * * *